US005746067A

United States Patent [19]

Leach, II et al.

[11] Patent Number: 5,746,067

[45] Date of Patent: May 5, 1998

[54] ROUND BANGLE

[75] Inventors: Edwin F. Leach, II; Marinko Markic, both of Attleboro, Mass.; Ronald E. Precourt, Jr., Woonsocket, R.I.

[73] Assignee: Leach & Garner Company, North Attleboro, Mass.

[21] Appl. No.: 831,904

[22] Filed: Apr. 2, 1997

[51] Int. Cl.[6] ..... A44C 5/18

[52] U.S. Cl. ..... 63/7; 63/9

[58] Field of Search ..... 63/3, 3.1, 7, 9; 24/685

[56] References Cited

U.S. PATENT DOCUMENTS

| | | | |
|---|---|---|---|
| 704,243 | 7/1902 | Davis | 63/7 |
| 725,322 | 4/1903 | Davis | 63/7 |
| 5,598,722 | 2/1997 | Leach, II et al. | 63/7 |

*Primary Examiner*—Kien T. Nguyen

*Attorney, Agent, or Firm*—Phillips, Lytle, Hitchcock, Blaine & Huber LLP

[57] ABSTRACT

A round bangle (20) has an improved clevis-like hinge assembly (23) and an improved bangle closing mechanism (24). The hinge assembly is in the form of two end caps, which are operatively mounted on adjacent marginal end portions of the bangle halves. A clevis-type connection is recessed in one of the bangle halves such that there is the appearance of a generally smooth continuous exterior when the bangle is closed. The improved closing mechanism includes a keeper wire (42) extending outwardly from one of the bangles within the other, with an intermediate support ball (43) and a distal button (44) located on the keeper wire. When the bangle is closed, the button passes through an opening (45) in the other bangle half to releasably lock the bangle halves together.

11 Claims, 3 Drawing Sheets

ROUND BANGLE

TECHNICAL FIELD

The present invention relates generally to the field of bangles and hollow bracelets, and, more particularly, to an improved round bangle having two semi-circular bangle halves arranged to simulate a circle or ring, and with: (1) a unique hinge mechanism between one set of adjacent ends, and (2) a unique closing mechanism between the other set of adjacent ends.

BACKGROUND ART

A bangle is generally defined as being a rigid bracelet or anklet, particularly one with no clasp. A secondary definition is an ornament that hangs from a bracelet or necklace.

Some bangles are in the form of annular or ring-like members. While these bangles may be tubular, it may be cosmetically desirable that the bangle emulate a generally-continuous annular outer shape or appearance, when closed. At the same time, the bangle must be capable of being selectively opened so as to allow it to be put on or taken off the wearer's wrist or ankle, or that it be permitted to interfit with other jewelry.

To this end, considerable effort has been directed toward the development of improved bangle closing mechanisms. See, e.g., U.S. Pat. No. 5,598,722, which is assigned to the assignee of the present invention. That application discloses a round bangle having two semi-circular bangle halves with a type of closing mechanism therebetween.

It would be generally desirable to provide an improved hinge for a bangle, and, in particular, a round bangle, in which the hinge mechanism is substantially concealed from view when the bangle is closed.

It would also be desirable to provide an improved bangle closing mechanism, again particularly for a tubular or round bangle, in which much of the closing mechanism is hidden from view when the bangle is closed, so that the bangle presents the outward appearance of a smooth, continuous and substantially-uninterrupted annular ring.

Additional details concerning jewelry hinges are representatively shown and described in U.S. Pat. Nos. 3,948,040 and 4,546,040. Various forms of jewelry clasps are shown and described in U.S. Pat. Nos. 833,458, 1,361,645, 3,350,645, 3,350,764, 3,412,577, 3,600,917, 4,055,057 and 4,270,249.

DISCLOSURE OF THE INVENTION

With parenthetical reference to the corresponding parts, portions or surfaces of the disclosed embodiment, merely for purposes of illustration and not by way of limitation, the present invention provides two unique improvements in a tubular bangle, and, more particularly, in a round bangle (20) having at least one, and possibly two semi-circular tubular bangle halves (21, 22). In such a bangle, the two bangle halves are adapted to be series-connected so as to simulate an annular ring when closed, and are relatively movable to allow the bangle to be put on or taken off the wearer's wrist or ankle.

In one aspect, the invention provides an improved clevis-like hinge assembly (23) for operatively connecting the bangle members and for allowing relative movement therebetween. In this aspect, the improved hinge assembly includes a first portion (25) and a second portion (26). The first portion is mounted on a first of the bangle members (22). The first portion has two transversely-spaced knuckles (31, 32) surrounding transversely-aligned holes (33, 34). The second portion (26) is mounted on a second of the bangle members (21). The second portion has a tongue (30) which is adapted to fit between the first portion knuckles. The tongue has a transverse through-hole (38) aligned with the knuckle holes. The hinge assembly also includes a pin (39) which is arranged in the tongue and knuckle holes such that the two bangle members may be moved relative to one another about the axis (x—x) of the pin. Preferably, the two bangle halves are closely spaced to one another when the bangle is closed so as to create the visual impression of a substantially zero-clearance joint therebetween. To this end, one of the bangle marginal end portions may have a concave surface (40) arranged in closely-spaced facing engagement to the end of the other bangle half.

If the invention has two bangle halves, then each of the members is simply one of the halves. However, some other shape or form of bangle, whether presently known or unknown, might have two or more series-connected segments or sections. Thus, the word "members" as used in the appended claims is intended to encompass these arrangements as well. The invention is also particularly useful with a round bangle, having two semi-circular tubular bangle halves. End caps may close the proximate ends of the bangle halves. One end cap may have the hinge first portion (25) mounted thereon, with the first portion being recessed within the associated bangle half when the bangle is assembled. The second portion (26) may extend outwardly in a hook or L-shaped manner from the other end cap closing the cooperative bangle, with the tongue arranged to penetrate the first bangle end cap and to fit inter-digitally between the two knuckles. In this manner, the hinge assembly will be relatively concealed from view when the bangle is closed. To this end, one of the end caps may have a concave surface (40) facing the other of the end caps to accommodate relative pivotal movement of the two bangle halves about the axis of the pin.

In another aspect, the invention provides an improved bangle closing mechanism (24) for use wherein at least one bangle member is in the form of an elongated hollow tube. In this form, the improved closing mechanism broadly includes an opening provided through the hollow bangle member, having one end mounted on the other bangle member and having its distal end arranged within the tubular bangle member and biased to move outwardly into continuous engagement with the tubular wall thereof. The improved closing mechanism may include a keeper (42), a ball-like support (43), and a button (44), or a portion configured as a button, which is mounted on the keeper wire distal end and is operatively arranged to selectively pass through the opening to releasably hold the bangle members together. The button may be pushed inwardly through the hole to allow the bangle members to be moved relative to one another. If the keeper wire is arcuate, it may have a radius of curvature which is greater than the radius of curvature of the bangle half in which its distal end is arranged, such that the distal end and button will be biased to move radially outwardly into engagement with the facing portion of the bangle half wall. In a tubular bangle, the keeper wire may have one end mounted on an end cap, and have an intermediate portion of its longitudinal extent arranged to penetrate the end cap of the other bangle half. The keeper wire, the support ball and the button are not limited to the particular configurations shown, but may be formed of other cross-sectional shapes and configurations as well, and can be either hollow or solid, as desired.

Accordingly, the general object of this invention is to provide an improved bangle.

Another object is to provide an improved hinge assembly for use in a bangle, and, in particular, for use in a bangle having at least one tubular bangle member.

Another object is to provide an improved hinge assembly for a bangle, in which the mechanical portion of the hinge mechanism is concealed from view when the bangle is closed.

Another object is to provide an improved closing mechanism for a bangle having at least one tubular member, and which closing mechanism is relatively obscured and unnoticeable when the bangle is closed.

These and other objects and advantages will become apparent from the foregoing and ongoing written specification, the drawings, and the appended claims.

DESCRIPTION OF THE PREFERRED EMBODIMENTS

Figure 2:
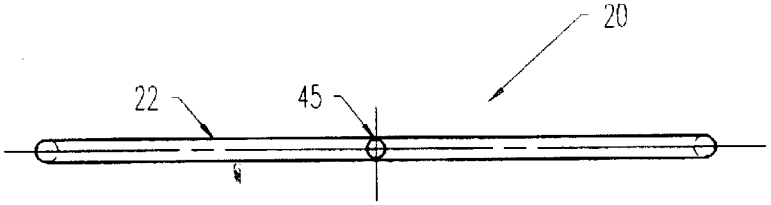
FIG. 2 is a top plan view of the bangle shown in FIG. 1, and depicts the hole through which the button is adapted to extend when the bangle is closed.

At the outset, it should be clearly understood that like reference numerals are intended to identify the same structural elements, portions or surfaces consistently throughout the several drawing figures, as such element, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, the present invention provides two improvements in a round bangle or bracelet, generally indicated at 20. This bangle is shown as being an annular or ring-like member having two semicircular bangle halves, 21, 22, respectively. The bangle is further shown as having an improved hinge assembly, generally indicated at 23, and an improved closure mechanism, generally indicated at 24.

When the bangle halves are closed, as when normally encircling a person's wrist or ankle, they emulate the outward appearance of a donut-shaped tubular ring. However, the purpose of hinge assembly 23 is to allow the bangle halves to move pivotally relative to another, as when the bangle halves are moved between their opened and closed relative positions. The function of closure mechanism 24 is to permit such movement of the other end of the bangle halves, such as to enable the bangle to be slipped on or off other structure or the object to be encircled. In the preferred embodiment, it should be noted that the closure mechanism and the hinge assembly are located at diametrically-opposite locations, although this is not invariable.

Figure 3:
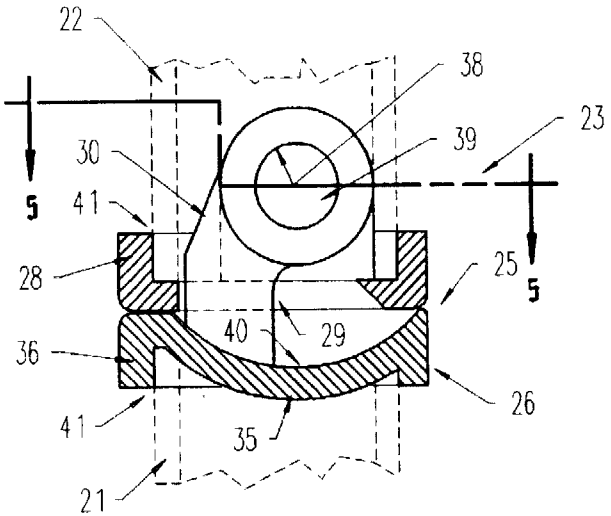
FIG. 3 is an enlarged detail view of the clevis-like hinge assembly shown in FIG. 1, with marginal end portions of the tubular bangle halves being shown in phantom to better illustrate the end caps, the knuckles and the tongue, this view showing the hinge as being closed.
Figure 4:
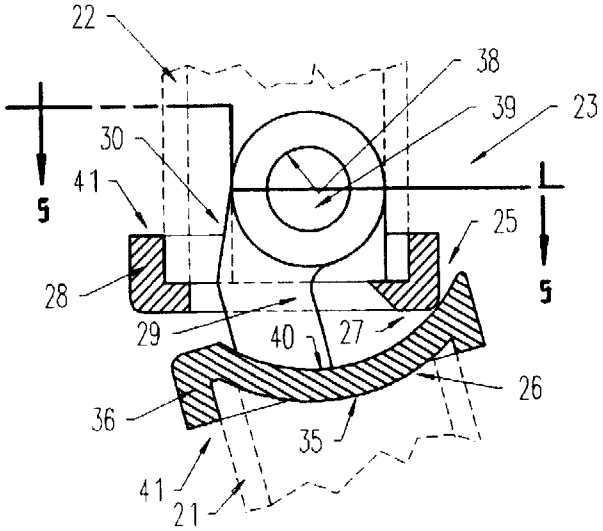
FIG. 4 is a view similar to FIG. 3, but shows the bangle halves as having been relatively rotated through an angle of about 15° from the position shown in FIG. 3.
Figure 5:
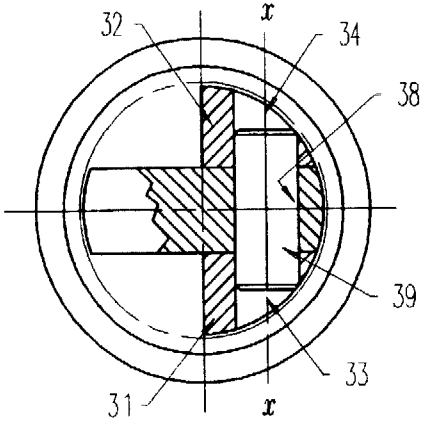
FIG. 5 is a fragmentary transverse sectional view thereof, taken generally on line 5—5 of FIG. 3, and shows the tongue as fitting inter-digitally between the knuckles.

Referring now to FIG. 3, the improved hinge assembly 23 is shown as being operatively arranged between the proximate ends of the bangle halves 21, 22. As best shown in FIGS. 3 and 4, the improved hinge assembly includes a first portion 25 mounted on bangle member 22, and a second portion 26 mounted on bangle member 21. The first portion is shown as being in the form of an end cap 27 having an outer annular flange 28 adapted to embrace the marginal end portion of bangle member 22. This end cap is shown as having an opening 29 to accommodate passage of the tongue 30 of the other bangle portion. As best shown in FIG. 5, the first portion has two transversely-spaced knuckles 31, 32, respectively. Each knuckle has a hole aligned with the other. Thus, left knuckle 31 has a hole 33, and right knuckle 32 has a hole 34. Holes 33 and 34 are transversely aligned with one another along axis x—x.

The second hinge portion 26 is shown as having a cooperative end cap central or concave portion 35, and an outermost annular flange 36 adapted to embrace the outer marginal end portion of bangle member 22. Tongue 30, which is configured as a hook-shaped member, extends outwardly from portion 35, and has a portion arranged to fit between knuckles 31, 32. The tongue is shown as having a hole 38 adapted to register with knuckle holes 33 and 34. A cylindrical pin 39 is shown as being arranged in holes 33, 34, 38 to allow the two parts of the hinge assembly to pivot about the axis x—x of the pin. In this regard, it should be pointed out that the concave surface 40 of wall portion 35 is arranged to pass by the first portion when the two sections are rotated, as comparatively illustrated in FIGS. 3 and 4.

In the preferred embodiment, the improved hinge assembly is formulated with end caps. These end caps may be appropriately soldered or braised, as indicated at 41, to the associated bangle half.

Figure 1:
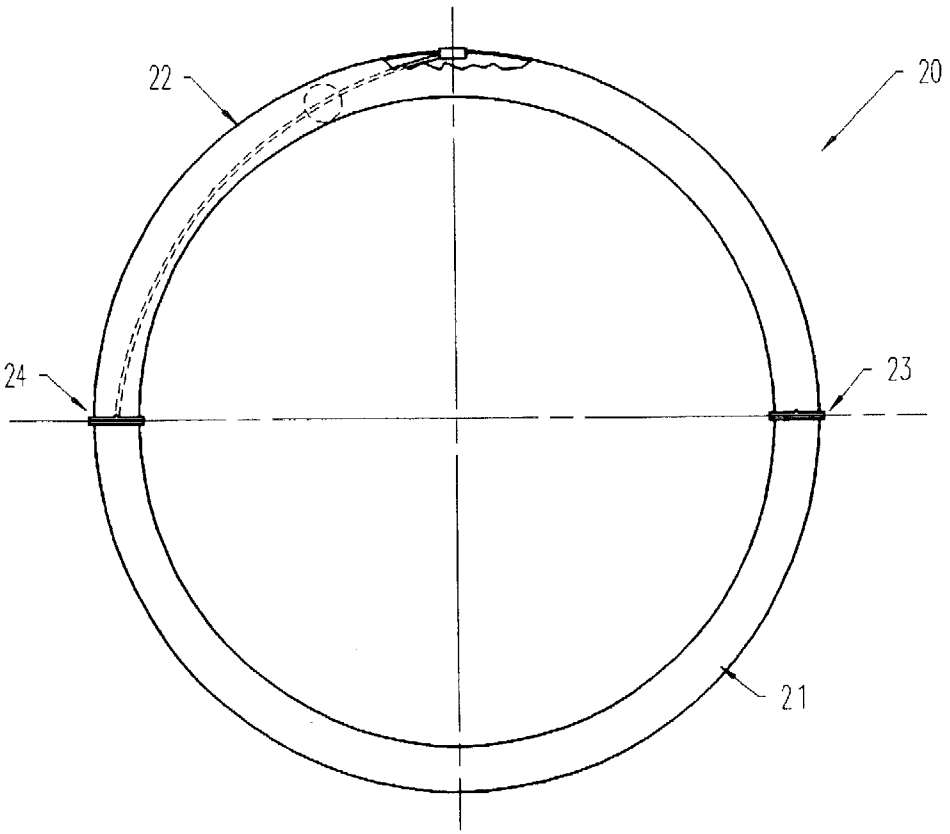
FIG. 1 is a side elevation of an improved two-piece round bangle incorporating the improved hinge assembly and the improved closing mechanism.
Figure 6:
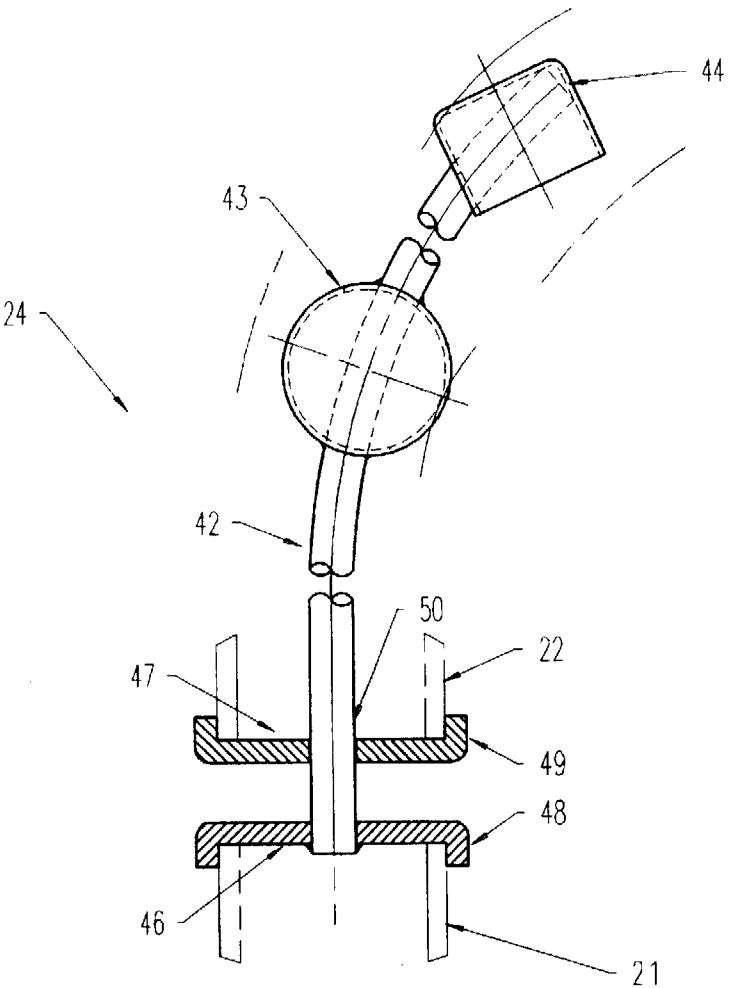
FIG. 6 is an enlarged view of the closing mechanism assembly, this view showing the keeper wire as having one marginal end portion secured to one end cap, with an intermediate portion of the keeper wire penetrating the other end cap and terminating in a locking button at its distal end.

Adverting now to FIGS. 1, 2 and 6, the improved bangle closing mechanism 24 is shown as being operatively arranged between the two bangle halves. This closure mechanism 24 is shown as generally including a keeper wire 42 extending upwardly from bangle member 21, with a round or spherical flexure support 43 suitably secured to an intermediate portion of wire 42, and with a button 44 operatively secured to the distal end portion thereof. In FIG. 2, the bangle member 22 is shown as having an aperture 45, through which button 44 is adapted to extend when aligned. The support provides an intermediate member about which the keeper wire is flexed. The keeper wire 41 may have a radius of curvature that is greater than the nominal radius of bangle member 22. Hence, the button is continuously urged to move radially outwardly against the inwardly-facing surface of bangle half 22.

To unlock the two bangle halves and to permit them to be moved relative to one another, a person need only depress the button 44 through opening 45. Thereafter, the two halves may be pivotally moved about the axis of pin 39, with the button riding on the inner surface of bangle 22. To close the bangle, the operation is simply reversed in that the two sections are brought together, by pivoting about pin 39, until such time as the button 44 snaps through opening 45.

Therefore, the invention provides two unique improvements to a round bangle. These improvements cooperate to allow the bangle to have a more continuous shape and appearance when closed. While the bangle may, if desired, be formed of a suitable precious metal or alloy, the particular materials of construction are not deemed to be critical, and may be varied. Similarly, the keeper may be biased or unbiased, as desired. In the accompanying drawings, the bangle is shown as having a thin-walled circular transverse cross-section. However, it should be clearly pointed out that the tubular bangle is not limited to this particular configuration, but could have other cross-sectional shapes and configurations as well.

Therefore, while preferred forms of the inventive hinge assembly and bangle closing mechanism have been shown and described, and certain modifications and changes thereof discussed, persons skilled in this art will readily appreciate that various additional changes and modifications may be made without departing from the spirit of the invention, as defined and differentiated by the following claims.

What is claimed is:

1. In a bangle having arcuately-elongated series-connected relatively-movable first and second tubular bangle members, the improvement which comprises:

a clevis-like hinge assembly operatively connecting said bangle members and allowing relative movement therebetween, said hinge assembly having a first portion mounted on said first bangle member, said first portion having two transversely-spaced knuckles provided with transversely-aligned holes, a second portion mounted on said second bangle member, said second portion having a tongue arranged between said first portion knuckles, said tongue having a transverse through-hole aligned with said knuckle holes, and a pin arranged in said tongue and knuckle holes, whereby said bangle members may be moved relative to one another about the axis of said pin.

2. The improvement as set forth in claim 1 wherein said tongue is a hook-shaped member.

3. The improvement as set forth in claim 1 wherein said first portion is recessed within said first bangle member.

4. The improvement as set forth in claim 3, and further comprising a first end cap mounted on a marginal end portion of said first bangle member, and wherein said hinge first portion is mounted on said first end cap.

5. The improvement as set forth in claim 4, and further comprising a second end cap mounted on a marginal end portion of said second bangle member, and wherein said hinge second portion is mounted on said second end cap.

6. The improvement as set forth in claim 5 wherein said second end cap has a concave surface arranged to face toward said first end cap, said second end cap surface being configured and arranged to pass by said first end cap when said bangle members are moved relative to one another about the axis of said pin.

7. The improvement as set forth in claim 6 wherein the proximate ends of said first and second bangle members are closely spaced from one another when said bangle is closed so as to simulate the outward appearance of a substantially-continuous annular ring.

8. In a bangle having series-connected relatively-movable arcuately-elongated tubular first and second bangle members, the improvement which comprises:

a bangle closing mechanism operatively arranged between said bangle members for releasably coupling said bangle members, said mechanism including an opening provided through the wall of said second bangle member;

a keeper wire having one end mounted on said first bangle member and having its distal end arranged within said second bangle member, said distal end being biased to move into continuous engagement with said second bangle member;

a support ball mounted on an intermediate portion of said keeper wire; and a button mounted on said keeper wire and operatively arranged to have a portion thereof selectively pass through said opening to releasably hold said bangle members together;

whereby said button portion may be pushed through said opening to allow said bangle members to be moved relative to one another.

9. The improvement as set forth in claim 8 wherein said keeper wire is arcuate, but has a radius of curvature greater than the radius of curvature of said second bangle member.

10. The improvement as set forth in claim 8 and further comprising a first end cap mounted on the open end of said first bangle member, and wherein one marginal end portion of said keeper wire is mounted on said first end cap.

11. The improvement as set forth in claim 10 and further comprising a second end cap mounted on said second bangle member marginal end portion, and wherein said keeper wire is arranged to slidably penetrate said second end cap.

* * * * *